US011583911B2

(12) United States Patent
Sun et al.

(10) Patent No.: US 11,583,911 B2
(45) Date of Patent: Feb. 21, 2023

(54) METHOD FOR CORELESS SPINNING OF LARGE-RATIO MULTI-VARIABLE-DIAMETER HOLLOW SHAFT

(71) Applicant: WUHU SANLIAN FORGING CO., LTD, Wuhu (CN)

(72) Inventors: Guofeng Sun, Wuhu (CN); Liang Han, Wuhu (CN); Xiaofeng Li, Wuhu (CN)

(73) Assignee: WUHU SANLIAN FORGING CO., LTD, Wuhu (CN)

( * ) Notice: Subject to any disclaimer, the term of this patent is extended or adjusted under 35 U.S.C. 154(b) by 21 days.

(21) Appl. No.: 17/297,955

(22) PCT Filed: Dec. 23, 2019

(86) PCT No.: PCT/CN2019/127336

§ 371 (c)(1),
(2) Date: May 27, 2021

(87) PCT Pub. No.: WO2021/051695

PCT Pub. Date: Mar. 25, 2021

(65) Prior Publication Data

US 2022/0088664 A1 Mar. 24, 2022

(30) Foreign Application Priority Data

Sep. 16, 2019 (CN) ..... 201910868743.3

(51) Int. Cl.
*B21D 22/16* (2006.01)

(52) U.S. Cl.
CPC ..... *B21D 22/16* (2013.01)

(58) Field of Classification Search
CPC ..... B21D 22/14; B21D 22/16
See application file for complete search history.

(56) References Cited

FOREIGN PATENT DOCUMENTS

| | | |
|---|---|---|
| CN | 207188564 U | 4/2018 |
| CN | 207447050 U | 6/2018 |
| CN | 108311577 A | 7/2018 |

(Continued)

OTHER PUBLICATIONS

Machine Translation for DE 3221899 A1 (Year: 1983).*
Machine Translation for CN 207188564 U (Year: 2018).*

*Primary Examiner* — David P Bryant
*Assistant Examiner* — Christine Bersabal

(57) ABSTRACT

The present invention discloses a method for coreless spinning of a large-ratio multi-variable-diameter hollow shaft, belonging to the field of spinning. The present invention includes following steps: S1: clamping a blank in a lower die unit, driving the workpiece to rotate, causing a rough spinning wheel and a fine spinning wheel to be in contact with the workpiece for staggered spinning, and performing curved reciprocating feed spinning via point contact to form a roughly-spun blank; S2: shifting the rough spinning wheel and the fine spinning wheel, causing shaping spinning wheels to be in contact with the workpiece for shaping spinning, and subjecting the shaping spinning wheels to linear contact shaping and fine spinning only in a radial direction, to obtain a finely spun blank. The present invention solves the problems of high machining difficulty and poor molding quality of hollow shafts in the prior art.

8 Claims, 8 Drawing Sheets

(56) References Cited

FOREIGN PATENT DOCUMENTS

| | | | | | |
|---|---|---|---|---|---|
| CN | 108311577 | B | | 9/2019 | |
| CN | 110548797 | A | | 12/2019 | |
| CN | 210523513 | U | | 5/2020 | |
| DE | 3221899 | A | * | 12/1983 | ..... B21D 22/14 |
| DE | 3221899 | A1 | | 12/1983 | |
| JP | 2007283366 | A | | 11/2007 | |

* cited by examiner

METHOD FOR CORELESS SPINNING OF LARGE-RATIO MULTI-VARIABLE-DIAMETER HOLLOW SHAFT

TECHNICAL FIELD

The present invention relates to the technical field of spinning, and in particular, to a method for coreless spinning of a large-ratio multi-variable-diameter hollow shaft.

BACKGROUND

New energy vehicles are an inevitable trend in the development of vehicles in the world today. All countries are racing to develop various types of high-density batteries or other power sources to continuously increase the driving range, and have achieved good results. The market development potential of new energy vehicles is undoubtedly huge. The new energy vehicle industry has increasingly stringent requirements on the weight and quality of internal parts of a vehicle body. At present, the design of hollow axles is widely used in new energy vehicles, and especially the application of variable-diameter long shaft type hollow shafts has attracted more and more attention. The manufacturing of variable-diameter hollow long shaft workpieces in the industry mainly includes the following methods: (1) a forging technology is used to forge seamless steel tubes with large diameters into stepped tubes with different diameters, but the process has low production efficiency and material utilization, and the large tonnage of forging devices results in high costs; (2) a welding process is utilized to weld seamless steel tubes of different sizes together to form stepped tubes of different diameters, but the products manufactured by using this process have obvious strength risks; (3) a solid bar is used to finely turn dimensions required by drawings, but this method uses a solid inner hole, which increases material costs and makes it difficult to reduce the weight.

Spinning is an advanced technology that implements chipless forming and combines the characteristics of forging, extrusion, stretching, bending, ring rolling, rolling and other processes. It is an economical and optimal method for rapid forming of thin-walled rotary parts. When a conventional spinning process is used to manufacture hollow shaft parts, a mandrel and a tail top are often matched, but it is not suitable for precise machining of variable-diameter slender shafts, and especially multi-variable-diameter hollow shafts cannot be machined using mandrels. Ordinary spinning forming often has the problems that the axial runout is large, and a formed variable-diameter tube is prone to bending and poor flatness. Consequently, the forming length is extremely limited. The difficulty in material flow or local bending and deformation more easily leads to great reduction in forming quality and use performance. Therefore, a spinning process for variable-diameter hollow shafts, especially for the machining of large-ratio multi-variable-diameter hollow shafts, has always been a technical problem to which the industry is constantly pursuing a solution.

According to the searching, there have been a large number of patents on the optimization of the spinning technology. For example, Chinese patent No. CN 2010105448425 titled METHOD FOR DIELESS FLOATING BALL SPINNING OF VARIABLE-DIAMETER TUBE AND CLAMP is provided, in which a tube blank is subjected to segmented multi-pass spinning by using a special clamp, and the specific process includes determining the external diameter of each reduced-diameter segment through trial spinning, performing segmented spinning on each of the reduced-diameter segments, and reasonably controlling a spinning amount in each spinning process to finally obtain a formed pipe fitting. This application can effectively control the diameter of the thin-walled tube at the reduced-diameter position, and solves the technical problem of local reduction of the variable-diameter tube.

For another example, Chinese patent No. CN 2016103047475 titled METHOD AND APPARATUS FOR POWER SPINNING FORMING OF HIGH-TEMPERATURE ALLOY VARIABLE-DIAMETER TUBE is provided. The method includes: first fixing a high-temperature alloy tube on a spindle, measuring axial runout, and controlling the tube to be stably mounted on the spindle, mounting a mandrel on a tail top, inserting the mandrel into a tube blank, then selecting an appropriate spinning forming process, and using the motion of the tail top to apply tension to the tube blank to control the forming length and thickness of the tube in the spinning forming; and at this time, spinning the high-temperature alloy variable-diameter tube under the action of the feeding of a spinning wheel and the pulling force of the tail top to finally obtain a multi-segment variable-diameter tube with a uniform wall thickness. The above applications all involve the optimization of the spinning process for variable-diameter hollow shafts, but there is still room for further improvement.

SUMMARY

1. To-be-Resolved Problem

An objective of the present invention is to solve the problems of high machining difficulty and poor molding quality of multi-variable-diameter hollow shafts in the prior art, and provide a method for coreless spinning of a large-ratio multi-variable-diameter hollow shaft, where the spinning method overcomes the shortcomings of low machining efficiency, high costs, low strength and the like of a conventional technology; the product manufactured by using this method has high precision, can greatly reduce the subsequent machining allowance and have a high material utilization rate, the production cost is reduced, and thus the product is suitable for popularization and application.

2. Technical Solutions

In order to achieve the foregoing objective, the technical solution provided by the present invention is as follows:

A method for coreless spinning of a large-ratio multi-variable-diameter hollow shaft includes the following steps:

S1: using a vertical spinning system to clamp a hollow blank workpiece in a lower die unit, driving the workpiece to rotate by the lower die unit, causing a rough spinning wheel and a fine spinning wheel on both sides of the workpiece to be in contact with the workpiece simultaneously for staggered spinning, and performing curved reciprocating feed spinning via point contact to form a roughly-spun blank;

S2: driving the workpiece to continue to rotate by the lower die unit, shifting the rough spinning wheel and the fine spinning wheel on two sides of the workpiece in S1, causing shaping spinning wheels on two sides of the workpiece to be in contact with the workpiece for shaping spinning, matching the shape of each of the shaping spinning wheels with the required shape of the workpiece, and subjecting the shaping spinning wheels on two sides to linear contact shaping and fine spinning only in a radial direction, so as to obtain a finely spun blank; and S3: separately spinning, according to the above method, parts of the workpiece needing to be machined to obtain a rough blank.

Further, in step S1, when one end of the workpiece is formed to a desired height, an upper die unit is started to move downward, so that an upper die cavity at the bottom thereof is pressed at the top of the workpiece to keep the workpiece at a fixed height, and the rough spinning wheel and the fine spinning wheel on two sides of the workpiece continue to perform spinning.

Further, the rough spinning wheel includes a rough spinning forming segment for being in contact with the workpiece, and the fine spinning wheel includes a fine spinning forming segment for being in contact with the workpiece, where an arc R angle of the rough spinning forming segment is greater than that of the fine spinning forming segment.

Further, in step S1, the rough spinning wheel is in contact with the workpiece and performs curved reciprocating feed spinning via point contact, and then the fine spinning wheel is in contact with the workpiece to perform curved reciprocating feed spinning via point contact.

Further, the vertical spinning system includes the lower die unit for clamping a workpiece, and spinning wheel mounting units arranged on two sides of the lower die unit, the upper die unit is further arranged above the lower die unit, a rough spinning wheel and a shaping spinning wheel are mounted on the spinning wheel mounting unit on one side, a fine spinning wheel and a shaping spinning wheel are mounted on the spinning wheel mounting unit on the other side, the rough spinning wheel and the fine spinning wheel correspond to each other in position, and the shaping spinning wheels on the two sides correspond to each other in position.

Further, the upper die unit includes an upper die switch-over base and an upper die core, the bottom of the upper die core is provided with an upper die cavity, the upper die core is embedded in the upper die switch-over base, and the upper die core is in running fit and connection with the upper die switch-over base through a bearing.

Further, the upper die unit further includes a cover plate arranged below the upper die switch-over base, the cover plate is connected to the upper die switch-over base through a positioning bolt, a protruding segment is circumferentially arranged around an outer side of the upper die core, an extended segment is arranged around a bottom inner side of the cover plate, and the protruding segment matches and is in lap joint with the extended segment.

Further, the upper die core is in running fit with the upper die switch-over base through a radial bearing and a plane bearing.

3. Beneficial Effects

Compared with the prior art, the technical solutions provided by the present invention have the following beneficial effects:

(1) In the method for coreless spinning of a large-ratio multi-variable-diameter hollow shaft, a four-wheel spinning method in which a rough spinning wheel, a fine spinning wheel and shaping spinning wheels match each other is adopted, which can obtain a hollow long shaft workpiece through machining, save materials and make the product light, helping to achieve light weight of the product; the workpiece has high density and increased strength, and does not deform easily, and a metal streamline has the same direction as the stress, which can better withstand torsion; the machining efficiency of the workpiece is more than 5 times higher than that of a conventional product subjected to rotary swaging, and the product has more reliable machining quality than a welded product; and the spun rough blank has high precision, which can effectively reduce the chipping allowance and greatly reduce machining costs.

(2) In the method for coreless spinning of a large-ratio multi-variable-diameter hollow shaft according to the present invention, four-wheel staggered spinning is implemented, the rough spinning wheel is used to roughly machine the workpiece, and the fine spinning wheel is used to finely spin the workpiece, such that multi-pass spinning of the workpiece is implemented at the same time, which effectively improves production efficiency; the rough spinning wheel is mainly used for rolling and distributing a material to ensure that the material flows smoothly and is not thinned; the fine spinning wheel is symmetrical to the rough spinning wheel to eliminate imbalance of stress on the workpiece, and finely adjusts an arc angle of each reduced-diameter stepped surface of the workpiece to close to the arc angle of the finished product, to reduce the subsequent machining allowance.

(3) In the method for coreless spinning of a large-ratio multi-variable-diameter hollow shaft according to the present invention, an upper die unit is matched and arranged, an end of the workpiece is embedded in an upper die cavity when the workpiece reaches a required height, the upper die unit is pressed down to abut against an end surface of the workpiece, such that the length of the workpiece can be effectively controlled, the workpiece is prevented from continuing to grow in the axial direction, and thus the effect of increasing the wall thickness of the workpiece is achieved under the principle of constant material volume, to ensure accurate forming of the workpiece.

(4) In the method for coreless spinning of a large-ratio multi-variable-diameter hollow shaft according to the present invention, an upper die core is in running fit and connection with an upper die switch-over base through a bearing, such that the upper die core can be driven to synchronously rotate with the workpiece when abutting against the top of the rotating workpiece, and the upper die switch-over base is kept fixed, thereby reducing huge torsion borne by the workpiece during rotation, and effectively preventing the workpiece from being twisted off.

BRIEF DESCRIPTION OF DRAWINGS

FIG. 6 (B) is a schematic diagram of a cross-sectional structure of a fine spinning wheel;

FIG. 6 (C) is a schematic diagram of a cross-sectional structure of a shaping spinning wheel;

DESCRIPTION OF REFERENCE NUMERALS IN THE SCHEMATIC DIAGRAMS

Figure 1:
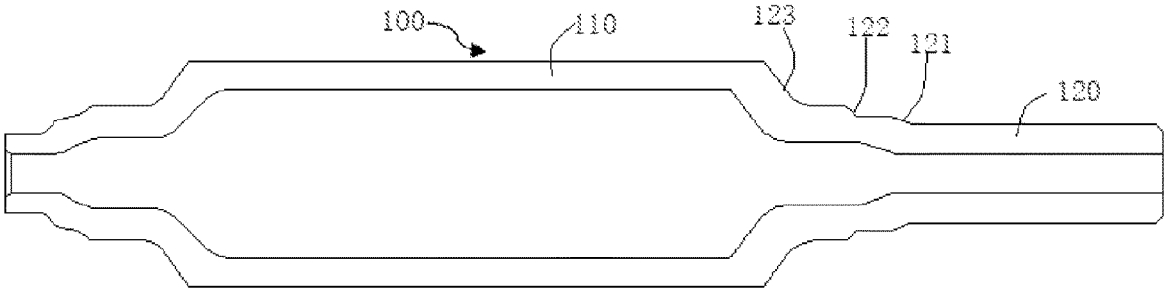
FIG. 1 is a schematic structural diagram of a hollow shaft in the present invention.

100. hollow shaft; 110. body segment; 120. small-diameter segment; 121. first reduced-diameter segment; 122. second reduced-diameter segment; 123. third reduced-diameter segment;

200. rough spinning wheel; 300. fine spinning wheel; 400. shaping spinning wheel; 500. lower die unit; 501. chuck; 600. upper die unit; 700. spinning wheel mounting unit;

210. rough spinning forming segment; 310. fine spinning forming segment; 410. first compressed-diameter segment; 420. second compressed-diameter segment; 430. third compressed-diameter segment;

610. upper die switch-over base; 611. radial bearing; 612. plane bearing; 620. cover plate; 621. positioning bolt; 630. upper die core; 631. upper die cavity; 632. protruding segment;

701. vertical leaning base; 702. mounting plate; 703. first mobile leaning base; 704. second mobile leaning base; 705. horizontal base plate; 710. spinning wheel shaft; 711. shaft sleeve; 720. spinning wheel seat; 721. connecting bearing; 722. flat keyway; 723. bearing cover; 724. stop washer; 725. washer.

DESCRIPTION OF EMBODIMENTS

In order to further understand the contents of the present invention, the present invention will be described in detail in conjunction with the accompanying drawings.

In the description of the present invention, it should be noted that orientations or position relationships indicated by terms "center", "top", "bottom", "left", "right", "vertical", "horizontal", etc. are orientation or position relationships as shown in the drawings, and these terms are just used to facilitate description of the present invention and simplify the description, but not to indicate or imply that the mentioned device or elements must have a specific orientation and must be established and operated in a specific orientation, and thus, these terms cannot be understood as a limitation to the present invention. Moreover, the terms such as "first" "second" and "third" are used only for the purpose of description and are not intended to indicate or imply relative importance.

The present invention will be further described below with reference to embodiments.

Embodiment 1

As shown in FIG. 1, a hollow shaft 100 to be machined and formed in this embodiment includes a hollow body segment 110, where one end of the body segment 110 is a small-diameter segment 120 with an inner diameter significantly reduced, and the small-diameter segment 120 extends by a certain length. A plurality of reduced-diameter segments with outer diameters gradually increased for transition are provided between the small-diameter segment 120 and the body segment 110, and specifically include a first reduced-diameter segment 121, a second reduced-diameter segment 122, and a third reduced-diameter segment 123 sequentially extending towards the body segment 110 from the small-diameter segment 120. Each of the reduced-diameter segments is an arc-shaped smooth transition segment. A flat extended segment is connected between the reduced-diameter segments. The reduced-diameter segments integrally form a stepped surface distribution, as shown in FIG. 1, and the other end of the body segment 110 is also provided with a reduced-diameter segment with a varying size according to usage requirements. Details will not be repeated herein.

The hollow shaft 100 of this embodiment is required to have high precision, and a shaft body is elongated and has a small inner diameter in structure, so that a conventional method of spinning with a mandrel and a tail top matching each other cannot be used, and the spinning difficulty is extremely high. The region of the small-diameter segment 120 has a smaller outer diameter, and is characterized by having a large closing ratio, a large variable-diameter ratio, and multiple intermediate variable diameters compared with the body segment 110, with a variable-diameter ratio reaching 1:3 or above. Therefore, during spinning, the material has a large flow volume, and loses stability easily, affecting machining quality. The small-diameter segment 120 and the reduced-diameter segments each have an increased wall thickness compared with the body segment 110, and it is extremely difficult to control thickening spinning for shear closing spinning. An inner cavity of the hollow shaft 100 is not machined. In order to ensure the dynamic balance of parts, the wall thickness of an entire profile needs to be kept uniform. How to spin the large-ratio multi-variable-diameter hollow shaft 100 has become a problem in the industry. The method for coreless spinning of a large-ratio multi-variable-diameter hollow shaft in this embodiment is exactly used for effective and precise spinning of the hollow shaft 100 with this special structure.

The method for coreless spinning of a large-ratio multi-variable-diameter hollow shaft in this embodiment includes the following steps.

Figure 2:
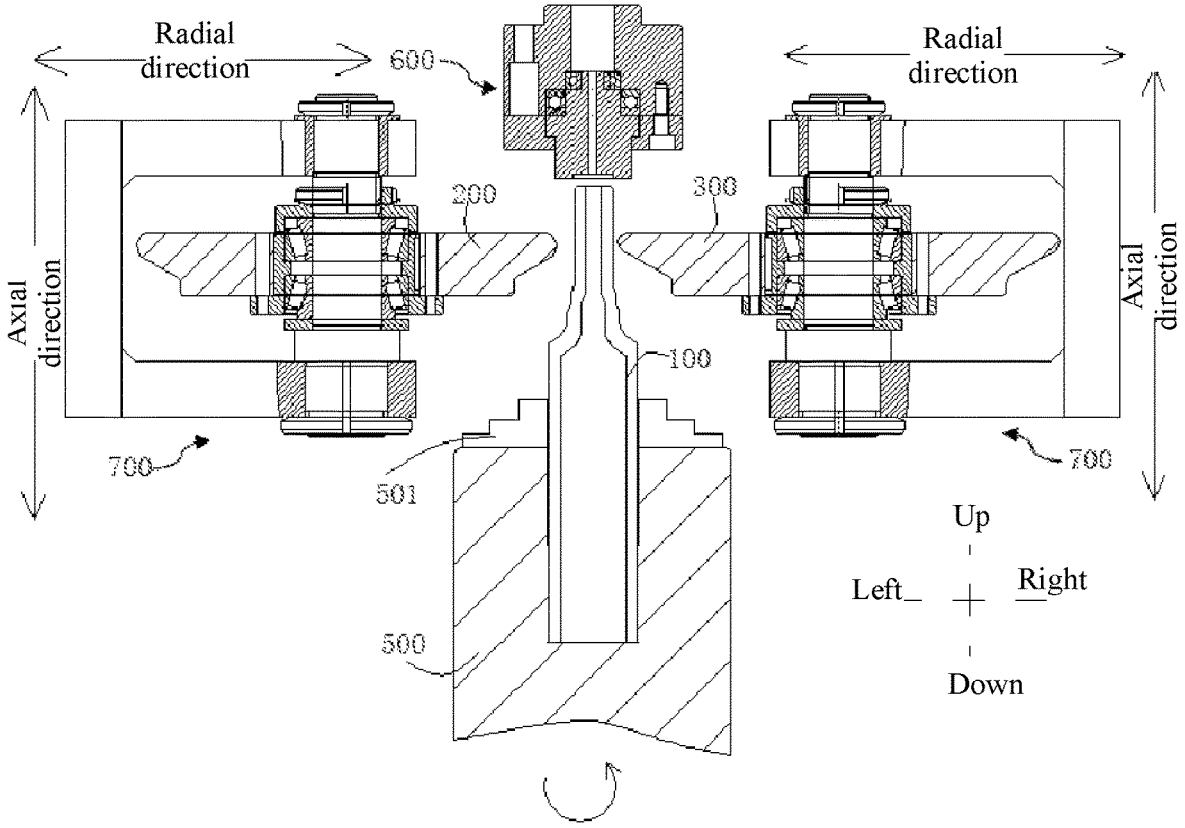
FIG. 2 is a schematic diagram of a pre-machining state of spinning in the present invention.

S1: Use a vertical spinning system to clamp a hollow blank workpiece in a lower die unit 500, drive the workpiece to rotate by the lower die unit 500, cause a rough spinning wheel 200 and a fine spinning wheel 300 on both sides of the workpiece to be in contact with the workpiece simultaneously for staggered spinning, and perform curved reciprocating feed spinning via point contact to form a roughly-spun blank. As shown in FIG. 2, the rough spinning wheel 200 and the fine spinning wheel 300 are separately in point contact with the workpiece, and perform reciprocating feed spinning in an axial direction and a radial direction, i.e., perform curved reciprocating feed spinning. The axial direction refers to the axial direction when the hollow shaft 100 is placed longitudinally, i.e., the vertical height direction in FIG. 2, and the radial direction refers to the diameter direction of the hollow shaft 100, i.e., the left and right horizontal direction in FIG. 2.

In this embodiment, the rough spinning wheel 200 and the fine spinning wheel 300 are actually in point contact with the blank, and the required spinning pressure is very small. After the workpiece is rotated, line contact is achieved in the workpiece deformation effect. After the rough spinning wheel 200 and the fine spinning wheel 300 move in the axial direction, the workpiece deformation effect is converted into the effect of surface contact. Combining the radial feed of the rough spinning wheel 200 and the fine spinning wheel 300, the effect of large volume changes can be achieved, and only a small spinning force is needed, which facilitates accurate control over the machining accuracy and ensures product quality.

Specifically, a seamless tube blank is cut on a sawing machine first according to required specifications, and then two end faces are finely turned on a numerically controlled lathe to ensure the perpendicularity of the end faces to the outer circle and the length of the tube blank and ensure accurate subsequent spinning positioning; and then the obtained blank is clamped. In this embodiment, vertical spinning is used to clamp the long shaft workpieces vertically. The rough spinning wheel 200 and the fine spinning wheel 300 perform staggered spinning forming from two sides, which can effectively avoid the length deformation and impact on runout and the like caused by self-weight during horizontal machining, thereby ensuring high product machining stability and high machining accuracy.

Figure 6A:
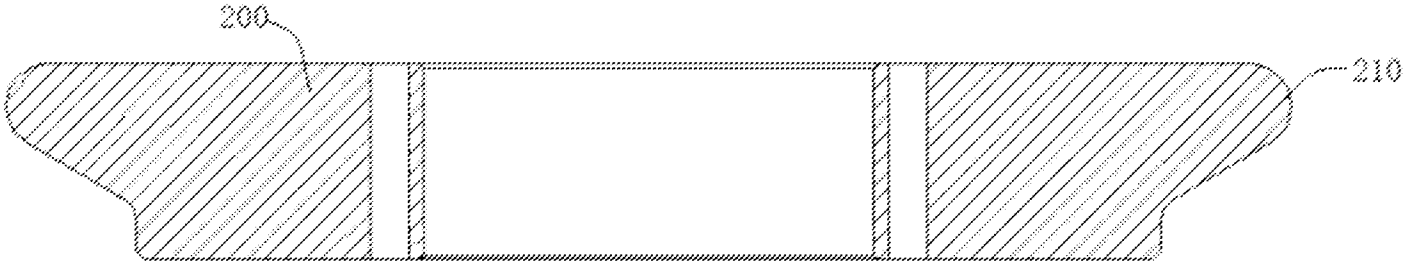
FIG. 6 (A) is a schematic diagram of a cross-sectional structure of a rough spinning wheel.
Figure 6B:
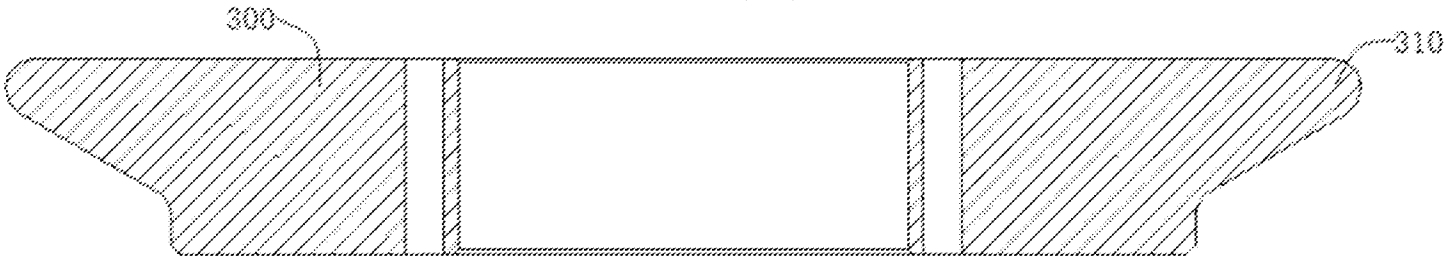
Figure 6C:
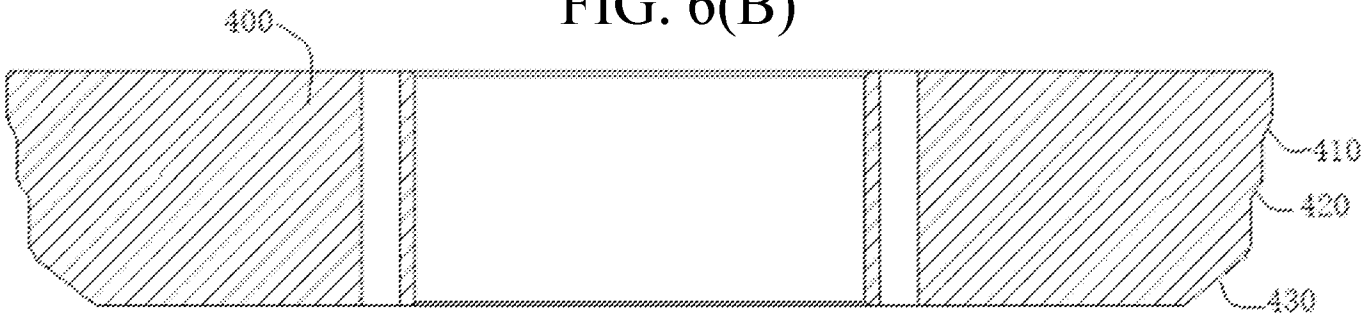

In this embodiment, the rough spinning wheel 200 and the fine spinning wheel 300 are initially symmetrically distributed on both sides of the workpiece at an angle of 180°. The double-wheel staggered spinning design is adopted to ensure the stable stress on both sides of the workpiece and improve the production efficiency. As shown in FIG. 6, the rough spinning wheel 200 includes a rough spinning forming segment 210 for contact with the workpiece, and the fine spinning wheel 300 includes a fine spinning forming segment 310 for contact with the workpiece. Reduced-diameter segments and flat segments extend below the rough spinning forming segment 210 and the fine spinning forming segment 310. An arc R angle of the rough spinning forming segment 210 is greater than an arc R angle of the fine spinning forming segment 310. The rough spinning wheel 200 is mainly used for rolling and distributing a material to ensure that the material flows smoothly and is not thinned; the fine spinning wheel 300 is symmetrical to the rough spinning wheel 200 to eliminate imbalance of stress on the workpiece, and finely adjusts an arc angle of each reduced-diameter stepped surface of the workpiece to close to the arc angle of the finished product, to reduce the subsequent machining allowance.

Figure 3:
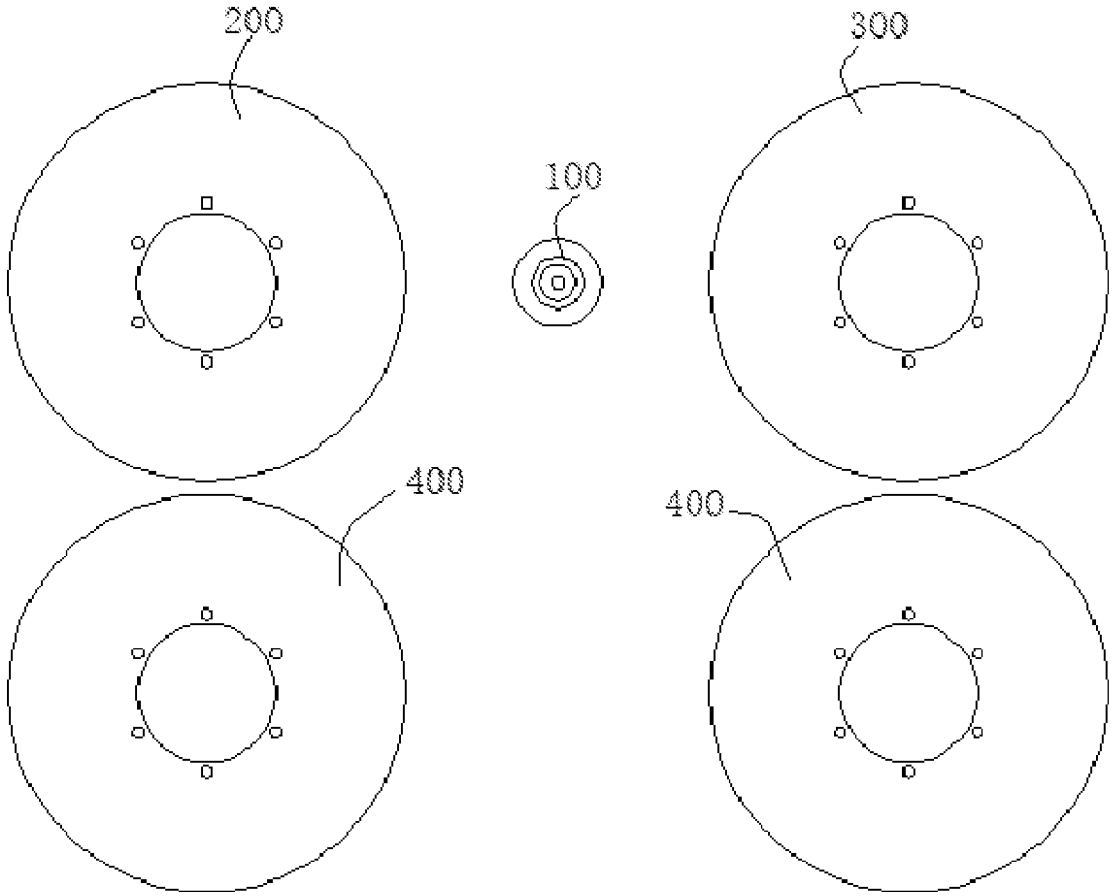
FIG. 3 is a schematic diagram of a top view distribution state of a spinning wheel in FIG. 2.

In this embodiment, during actual machining, the rough spinning wheel 200 and the fine spinning wheel 300 are initially located at the same height. The rough spinning wheel 200 is in contact with the workpiece and performs curved reciprocating feed spinning via point contact, and then the fine spinning wheel 300 is in contact with the workpiece to perform curved reciprocating feed spinning via point contact. The rough spinning wheel 200 and the fine spinning wheel 300 respectively perform feed spinning according to preset motion tracks, which effectively avoids the shortcomings in appearance such as folding, stacking, and wrinkling caused by poor material flow. In addition, the design of double wheels on both sides is adopted for staggered spinning. First, the rough spinning wheel 200 is used to roughly machine the workpiece, and on the basis of rough machining, the fine spinning wheel 300 is used to finely spin the workpiece, such that multi-pass spinning of the workpiece is implemented at the same time, which effectively improves production efficiency, as shown in FIG. 2 and FIG. 3.

It should be noted that, in step S1, when one end of the workpiece is formed to a desired height, an upper die unit 600 is started to move downward, so that an upper die cavity 631 at the bottom thereof is pressed at the top of the workpiece to keep the workpiece at a fixed height, and the rough spinning wheel 200 and the fine spinning wheel 300 on two sides of the workpiece continue to perform spinning. The inner diameter of the upper die cavity 631 is adapted to the outer diameter of the end of the workpiece needing to be formed. The end of the workpiece is embedded in the upper die cavity 631, such that the upper die unit 600 is pressed down to abut against an end surface of the workpiece, the length of the workpiece can be effectively controlled, the workpiece is prevented from continuing to grow in the axial direction, and the effect of increasing the wall thickness of the workpiece is achieved under the principle of constant material volume.

Figure 4:
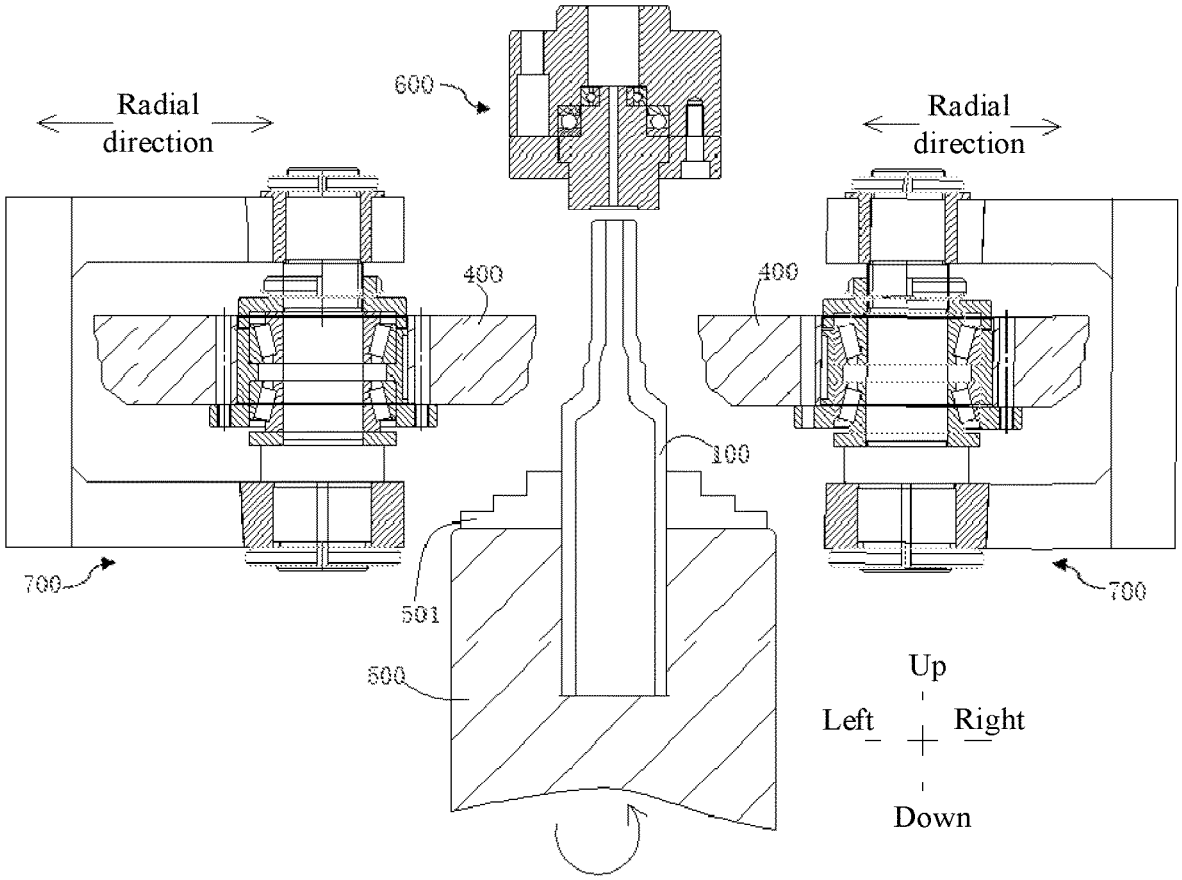
FIG. 4 is a schematic diagram of a post-adjustment state of spinning in the present invention.
Figure 5:
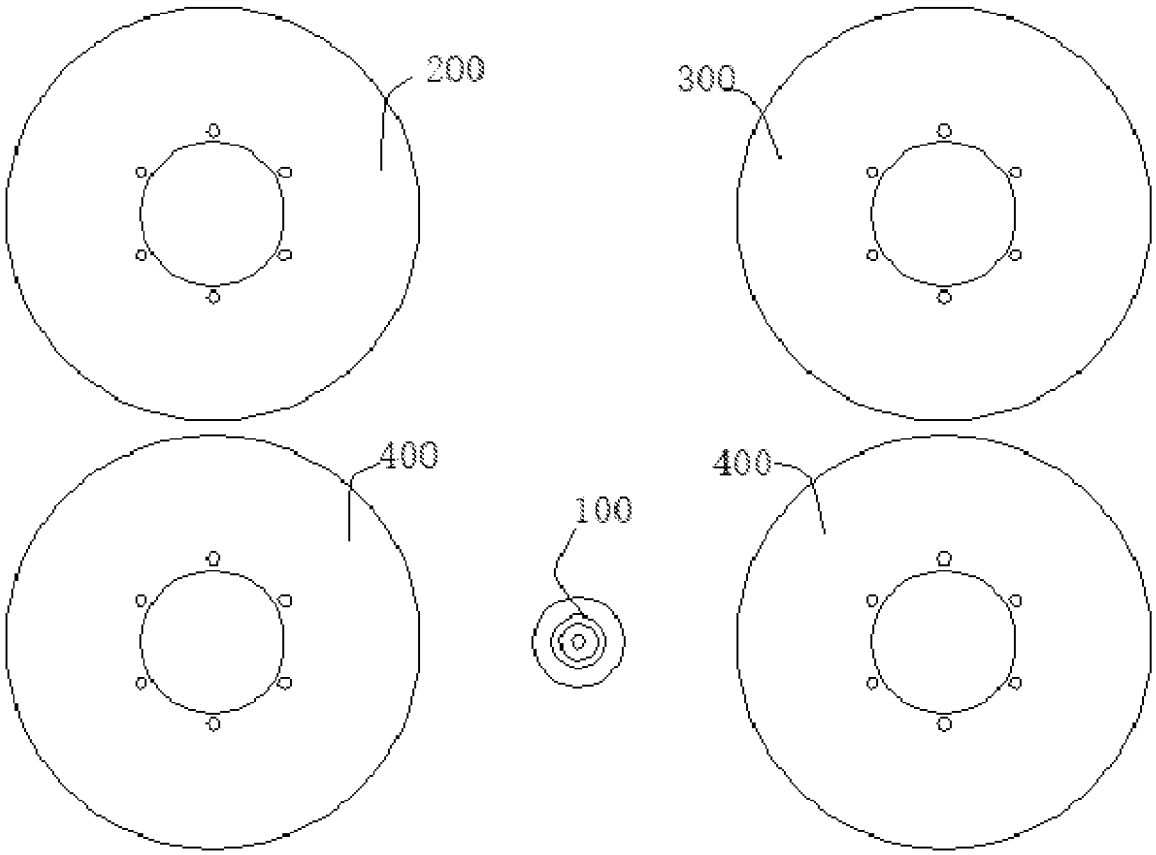
FIG. 5 is a schematic diagram of a top view distribution state of a spinning wheel in FIG. 4.

S2: Drive the workpiece to continue to rotate by the lower die unit 500, shift the rough spinning wheel 200 and the fine spinning wheel 300 on two sides of the workpiece in S1, cause shaping spinning wheels 400 on two sides of the workpiece to be in contact with the workpiece for shaping spinning, match the shape of each of the shaping spinning wheels 400 with the required shape of the workpiece, and subject the shaping spinning wheels 400 on two sides to linear contact shaping and fine spinning only in a radial direction, so as to obtain a finely spun blank. That is, the shaping spinning wheels 400 on two sides perform shaping spinning on the workpiece in the radial direction via line contact. As shown in FIG. 4 and FIG. 5, in this embodiment, the rough spinning wheel 200 and the fine spinning wheel 300 are directly shifted, such that the shaping spinning wheels 400 can be shifted to machining positions on two sides of the workpiece without repeating workpiece feeding and discharging operations during the shifting process, which ensures the workpiece positioning and clamping accuracy, and effectively improves the machining efficiency.

In this embodiment, the shape of the shaping spinning wheel 400 matches the shape of the hollow shaft 100, and the workpiece is formed directly via the radial line contact and spinning by the shaping spinning wheel 400. As shown in FIG. 6, the shaping spinning wheel 400 is sequentially provided with a first compressed-diameter segment 410, a second compressed-diameter segment 420, and a third compressed-diameter segment 430 from top to bottom, and a flat extended segment is connected between the compressed-diameter segments. The first compressed-diameter segment 410, the second compressed-diameter segment 420, and the third compressed-diameter segment 430 match the first reduced-diameter segment 121, the second reduced-diameter segment 122, and the third reduced-diameter segment 123 of the hollow shaft 100 respectively in shape and used to directly form the workpiece, which can be greatly reduce subsequent fine machining amount.

S3: Spin, according to the above method, parts of the workpiece needing to be machined to obtain a rough blank, and then perform auxiliary fine machining on the rough blank according to machining requirements. For example, in this embodiment, the above staggered spinning method is used to spin two ends of the hollow shaft 100 to obtain the rough blank, and then auxiliary subsequent fine machining is performed to obtain the final finished hollow shaft 100.

According to the spinning method in this embodiment, a thin-walled hollow blank can be directly machined using a metal spinning forming technique to obtain a hollow long shaft workpiece, which saves materials and makes the product light, reduces the weight by 50% or above compared with a solid shaft, and helps to achieve light weight of the product. The spinning rotational inertia is small, which can effectively increase the service life of a rotating power device. The workpiece has high density and increased strength, and because the workpiece is a hollow shaft, the workpiece has small stress and does not deform easily. A metal streamline has the same direction as the stress, which can better withstand torsion. The machining efficiency of the workpiece is more than 5 times higher than that of a conventional product subjected to rotary swaging, and the product has more reliable machining quality than a welded product; and the spun rough blank has high precision, which can effectively reduce the chipping allowance and greatly reduce machining costs. When the spinning wheel performs curved reciprocating feed spinning along a specified track, the volume flow of the blank in the axial direction can be implemented via the point contact between the spinning wheel and the workpiece, and the length and thickness of the product are increased by designing different spinning wheel shapes, engagement of the cutting edge, the motion track, etc., so as to implement large-ratio multi-variable-diameter coreless spinning, and finally meet design requirements. The formed product has high precision and good roundness and concentricity; the machining allowance can be reduced to a large extent, the material utilization rate is high, and the material cost is reduced. The compressive stress that the device needs to withstand when the material flows is greatly reduced during the spinning, so that the device cost is reduced and is low; the spinning without cutting is implemented, the spinning process has small noise, and there is no impact on the surrounding environment. In conclusion, when used to machine the long hollow shaft, the spinning process of this embodiment saves energy, reduces consumption, makes the product quality high, has low machining costs and a wide range of applications, can be used to spin any metal, and is suitable for popularization and application.

Embodiment 2

A method for coreless spinning of a large-ratio multi-variable-diameter hollow shaft according to this embodiment is substantially the same as that of Embodiment 1. Further, a vertical spinning system applied in this embodiment includes a lower die unit 500 for clamping a workpiece, and spinning wheel mounting units 700 arranged on two sides of the lower die unit 500, as shown in FIG. 2, an upper die unit 600 is further arranged above the lower die unit 500, a rough spinning wheel 200 and a shaping spinning wheel 400 are mounted on the spinning wheel mounting unit 700 on one side, a fine spinning wheel 300 and a shaping spinning wheel 400 are mounted on the spinning wheel mounting unit 700 on the other side, the rough spinning wheel 200 and the fine spinning wheel 300 correspond to each other in position, and the shaping spinning wheels 400 on the two sides correspond to each other in position. When in use, the workpiece is clamped in the lower die unit 500 and the lower die unit 500 drives the workpiece to rotate. The spinning wheels on both sides of the workpiece are in contact with the workpiece and rotate passively, and perform feed spinning along a predetermined track. When the workpiece is formed to a required height, the upper die unit 600 is pressed down to abut against an end face of the workpiece to limit the height of the workpiece, and the spinning wheels continue the spinning.

Figure 7:
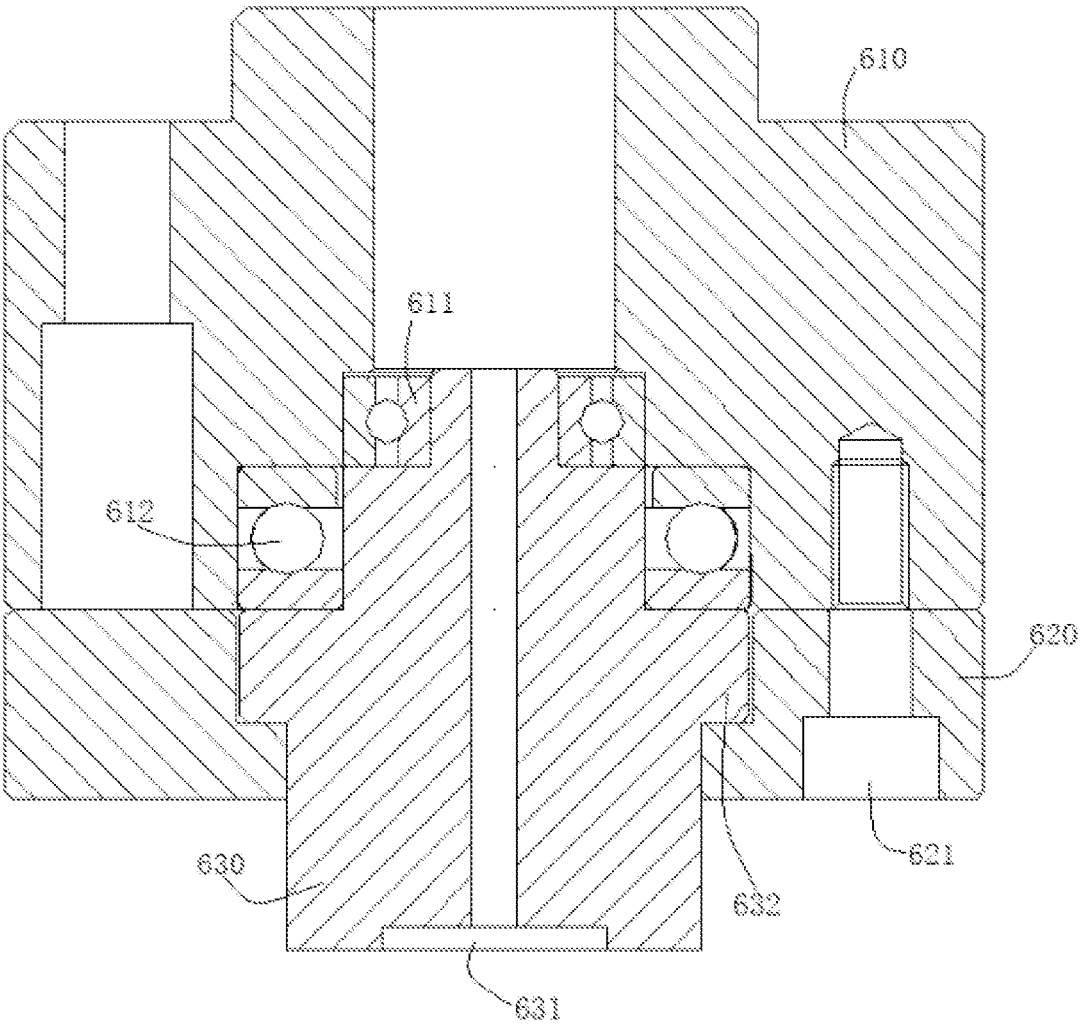
FIG. 7 is a schematic structural diagram of an upper die unit in the present invention.

As shown in FIG. 7, in this embodiment, the upper die unit 600 includes an upper die switch-over base 610 and an upper die core 630, where the upper die switch-over base 610 is connected to pushing power such as a cylinder/hydraulic cylinder, so as to drive the upper die switch-over base 610 to move up and down. A center of the bottom of the upper die switch-over base 610 is provided with a certain mounting cavity. The upper die core 630 is correspondingly embedded in the upper die switch-over base 610. The bottom of the upper die core 630 is provided with an upper die cavity 631, and the upper die cavity 631 is used to press down and abut against the top of the workpiece. The upper die core 630 is in running fit and connection with the upper die switch-over base 610 through a bearing, so that the upper die core 630 can be passively and synchronously rotated with the workpiece when abutting against the top of the rotating workpiece, and the upper die switch-over base 610 is kept fixed, thereby reducing huge torsion borne by the workpiece during rotation, and effectively preventing the workpiece from being twisted off.

In this embodiment, the upper die unit 600 further includes a cover plate 620 disposed below the upper die switch-over base 610. The cover plate 620 is connected to the upper die switch-over base 610 through a positioning bolt 621, and the degree of tightness between the cover plate 620 and the upper die switch-over base 610 can be controlled by rotating the positioning bolt 621. A middle portion of the cover plate 620 is also correspondingly provided with a mounting cavity for placing the upper die core 630, and a protruding segment 632 is circumferentially arranged around an outer side of a middle portion of the upper die core 630. An extended segment is correspondingly arranged around an inner side of the bottom of the cover plate 620, and the protruding segment 632 matches and is in lap joint with the extended segment; and a radial bearing 611 and a plane bearing 612 are arranged between the upper die core 630 and the upper die switch-over base 610 to implement running fit. Specifically, the top of the upper die core 630 is matched by the radial bearing 611, and an upper portion of the protruding segment 632 is matched by the plane bearing 612. A radial positioning bearing and a plane thrust bearing are separately used to implement running fit, so that the upper die core 630 can rotate relative to the upper die switch-over base 610. The upper die core 630 has a small structure and light weight, and can rotate with the workpiece flexibly, ensuring the stability of the workpiece forming.

Embodiment 3

Figure 8:
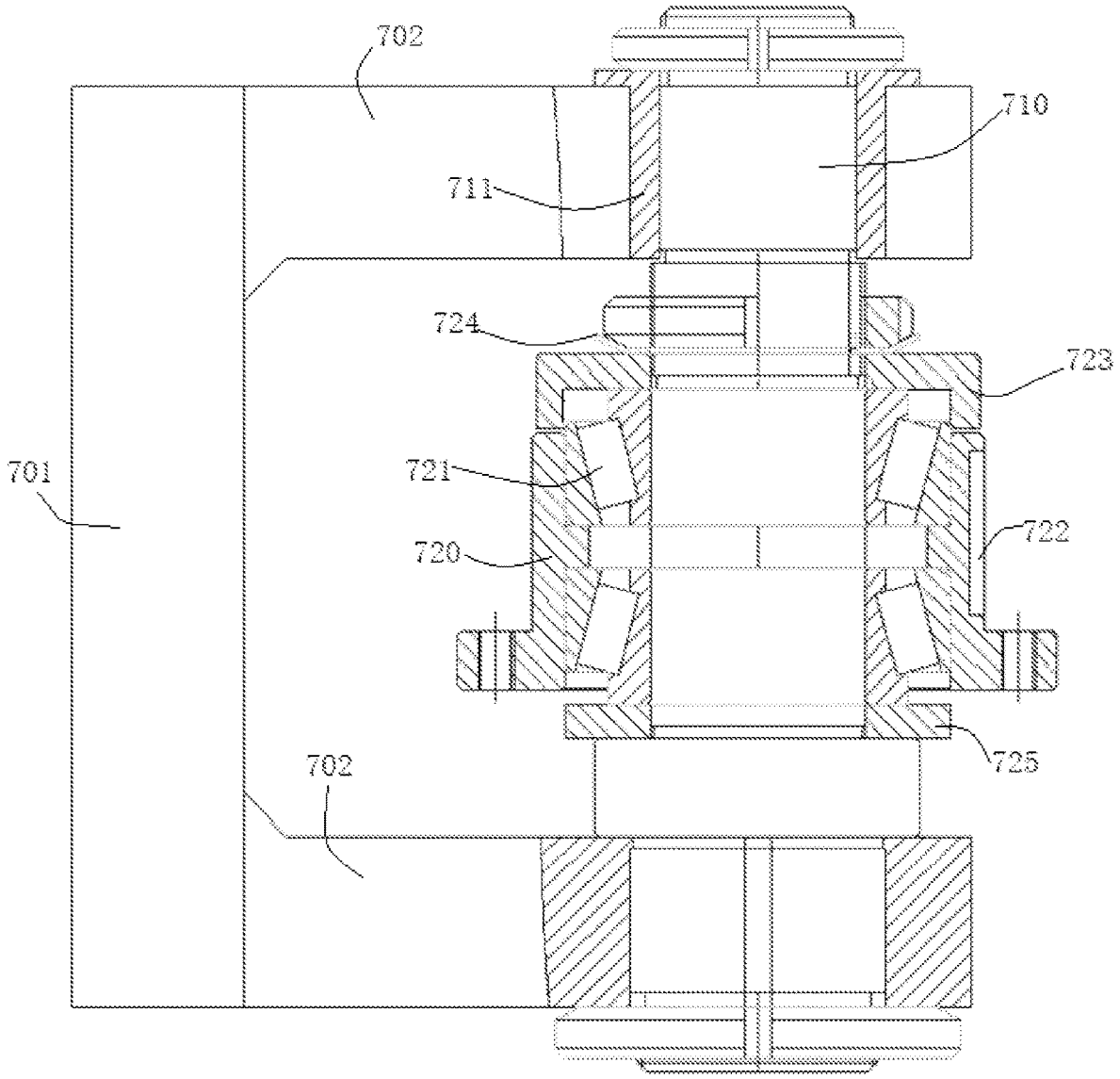
FIG. 8 is a schematic structural diagram of a spinning wheel mounting unit in the present invention.

A method for coreless spinning of a large-ratio multi-variable-diameter hollow shaft in this embodiment is substantially the same as that of Embodiment 2. Further, as shown in FIG. 8, a spinning wheel mounting unit 700 in this embodiment includes a vertical leaning base 701, where an upper end and a lower end of the vertical leaning base 701 are each provided with a mounting plate 702, and a spinning wheel is arranged between the mounting plates 702 at two ends. Specifically, a spinning wheel shaft 710 is arranged between the mounting plates 702 at two ends, and an end of the spinning wheel shaft 710 passes through the mounting plate 702 and is fastened by nuts at both ends. A shaft sleeve 711 is further arranged between the spinning wheel shaft 710 and the mounting plate 702, a middle portion of the spinning wheel shaft 710 is provided with a spinning wheel seat 720, a support ring segment is axially arranged around the bottom of the spinning wheel seat 720, and the spinning wheel is matched and mounted on the periphery of the spinning wheel seat 720 and located above the support ring segment. Specifically, the spinning wheel can be fastened and connected to the support ring segment by using a bolt. A flat keyway 722 is also provided on an outer side of the spinning wheel seat 720 in a height direction, and a flat key is fitted on the inner side of the spinning wheel in contact with the flat keyway, and is in flat key fit and connection with the spinning wheel seat 720 to prevent mutual rotation. The spinning wheel seat 720 is in running fit with the spinning wheel shaft 710. Specifically, connecting bearings 721 such as tapered roller bearings can be used at two ends respectively for running fit and connection, and the top of the connecting bearing 721 at the upper end is further provided with a bearing cover 723. A stop washer 724 is further arranged between the bearing cover 723 and a fastening nut above the same, and a washer 725 is also arranged between the bottom of the connecting bearing 721 at the lower end and a fastening nut below the same. When the spinning wheel is passively rotated with the workpiece, the entire spinning wheel seat 720 rotates relative to the spinning wheel shaft 710. In this embodiment, the rough spinning wheel 200, the fine spinning wheel 300, and the shaping spinning wheel 400 use this structure for fastening and mounting, so as to ensure the mounting position stability and rotation flexibility of the spinning wheel.

Figure 9:
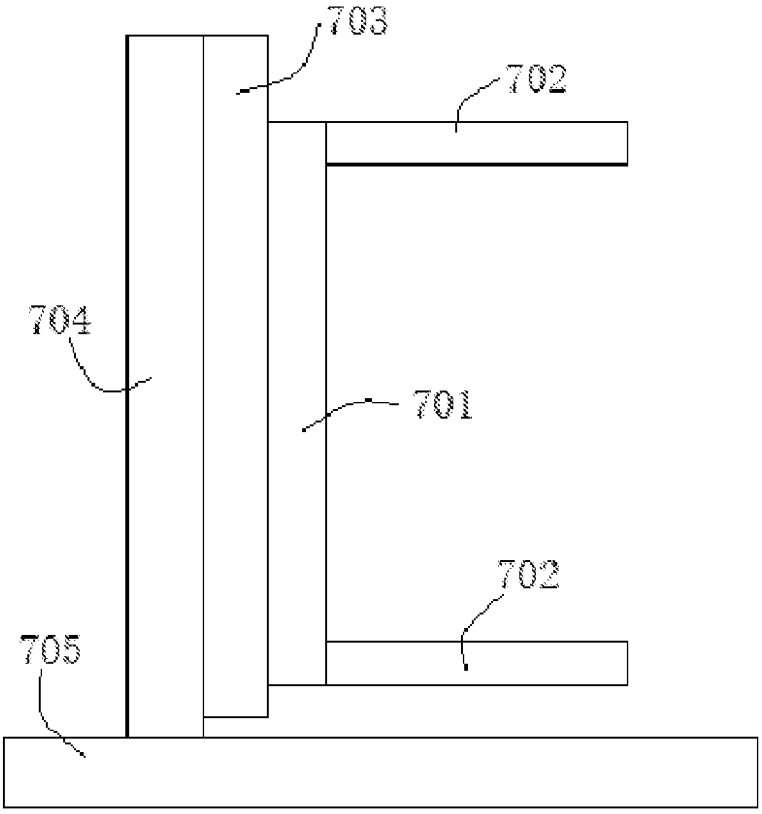
FIG. 9 is a schematic diagram of a mounting structure of a vertical leaning base in the present invention.

In this embodiment, the rough spinning wheel 200, the fine spinning wheel 300, and the shaping spinning wheel 400 all have a certain displacement feed during actual operation. The structure of the spinning wheel mounting unit 700 can effectively meet requirements on a running track of each spinning wheel. For example, when the rough spinning wheel 200 and the fine spinning wheel 300 on both sides of the workpiece need to perform curved reciprocating feed spinning, a cylinder/hydraulic cylinder may be used as pushing power. Specifically, taking the rough spinning wheel 200 as an example, as shown in FIG. 9, a machine tool of a vertical spinning system is provided with a horizontal base plate 705, and sliding rails are arranged on two sides of the horizontal base plate 705 respectively in the length direction; the bottom of a second mobile leaning base 704 is correspondingly provided with a matching slideway, and the second mobile leaning base 704 is connected to the pushing power and can be driven to move in the length direction of the horizontal base plate 705. The second mobile leaning base 704 matches and is provided with a first mobile leaning base 703. Similarly, the second mobile leaning base 704 is provided with a sliding rail in a height direction, the first mobile leaning base 703 is correspondingly provided with a matching slideway, and the first mobile leaning base 703 is connected to the pushing power and can be driven to move in the length direction of the second mobile leaning base 704. Similarly, the first mobile leaning base 703 is provided with a sliding rail in a width direction (i.e., a direction perpendicular to a paper surface), and a vertical leaning base 701 is correspondingly provided with a slideway; the vertical leaning base 701 is connected to the pushing power and can be driven to move in the width direction of the first mobile leaning base 703, such that three-direction displacement adjustment of the vertical leaning base 701 can be implemented. The shaping spinning wheel 400 and the rough spinning wheel 200 on the same side are arranged on the same vertical leaning base 701. After machining by the rough spinning wheel 200 is implemented and when the shaping spinning wheel 400 needs to be started, the relative position of the vertical leaning base 701 on the first mobile leaning base 703 is directly adjusted, so that the shaping spinning wheel 400 moves to the position corresponding to the workpiece. In actual operation, in the entire spinning process, a PLC control system can be adopted to automatically control and adjust the positions of the spinning wheels, so that each of the spinning wheels runs according to a specified track, which is easy to operate and effectively reduces labor costs.

Embodiment 4

A method for coreless spinning of a large-ratio multi-variable-diameter hollow shaft in this embodiment is substantially the same as that of Embodiment 3. Further, as shown in FIG. 2, a lower die unit 500 in this embodiment is configured to clamp, position and drive a workpiece. Specifically, the lower die unit 500 includes a clamping base, and the clamping base is provided with a placing cavity for placing the workpiece; a plurality of chucks 501 for clamping the workpiece are arranged around the placing cavity, the chucks 501 may have various clamping jaw structures common in the industry, can be synchronously and relatively inwardly close to the clamped workpiece or synchronously open outward to facilitate the removing of the workpiece, and details will not be repeated herein; protrusions distributed in dot shapes are evenly arranged at intervals on end faces of the chucks 501 in contact with the workpiece, which can effectively increase the friction and clamping force in contact with the workpiece, and prevent the workpiece from slipping and losing stability during machining. The clamping base is connected to rotating power such as a motor, and is driven by the same to rotate, so as to drive the workpiece to rotate for spinning. Specifically, a servo motor may be used, which has a fast production rhythm and high efficiency, and can significantly reduce time costs. In this embodiment, the two sides of the placing cavity are further provided with limiting grooves in the height direction respectively. When a blank workpiece is clamped, limiting protruding strips are welded at corresponding positions on both sides of the workpiece, and the limiting protruding strips of the workpiece are correspondingly embedded in the limiting grooves and the periphery of the workpiece is clamped by the chucks 501. This can effectively avoid relative rotation between the workpiece and the clamping base, further increase the stability of the clamping of the workpiece, prevent the slipping and instability of the workpiece, further enhance the machining accuracy of the product, and ensure the forming quality.

The present invention and embodiments thereof have been schematically described above, and the description is not restrictive. The accompanying drawing also shows only one embodiment of the present invention, and the actual structure is not limited thereto. Therefore, if a person of ordinary skill in the art designs similar structural modes and embodiments without creativity under the enlightenment without departing from the creation purpose of the present invention, the structural modes and the embodiments should fall within the protection scope of the present invention.

What is claimed is:

1. A method for coreless spinning of a large-ratio multi-variable-diameter hollow shaft, comprising the following steps:

S1: using a vertical spinning system to clamp a hollow blank workpiece in a lower die unit, driving the workpiece to rotate by the lower die unit, causing a rough spinning wheel and a fine spinning wheel on both sides of the workpiece to be in contact with the workpiece simultaneously for staggered spinning, and performing reciprocating feed spinning in an axial direction and a radial direction via point contact to form a roughly-spun blank; and S2: driving the workpiece to continue to rotate by the lower die unit, shifting the rough spinning wheel and the fine spinning wheel from the both sides of the workpiece on which the rough spinning wheel and the fine spinning wheel were located in S1, causing shaping spinning wheels to be in contact with the workpiece for shaping spinning, matching a shape of each of the shaping spinning wheels with a required shape of the workpiece, and using the shaping spinning wheels to shape the workpiece via linear contact and fine spinning only in the radial direction, so as to obtain a finely spun blank, wherein S1 and S2 are performed on a plurality of parts of the workpiece.

2. The method for coreless spinning of a large-ratio multi-variable-diameter hollow shaft according to claim 1, wherein in step S1, when one end of the workpiece is formed to a desired height, an upper die unit is started to move downward, so that an upper die cavity at the bottom thereof is pressed at the top of the workpiece to keep the workpiece at a fixed height, and the rough spinning wheel and the fine spinning wheel on two sides of the workpiece continue to perform spinning.

3. The method for coreless spinning of a large-ratio multi-variable-diameter hollow shaft according to claim 1, wherein the rough spinning wheel comprises a rough spinning forming segment for being in contact with the workpiece, and the fine spinning wheel comprises a fine spinning forming segment for being in contact with the workpiece, wherein an arc R angle of the rough spinning forming segment is greater than that of the fine spinning forming segment.

4. The method for coreless spinning of a large-ratio multi-variable-diameter hollow shaft according to claim 1, wherein in step S1, the rough spinning wheel is in contact with the workpiece and performs the reciprocating feed spinning via point contact, and then the fine spinning wheel is in contact with the workpiece to perform the reciprocating feed spinning via point contact.

5. The method for coreless spinning of a large-ratio multi-variable-diameter hollow shaft according to claim 1, wherein the vertical spinning system comprises the lower die unit for clamping a workpiece, and spinning wheel mounting units arranged on two sides of the lower die unit, an upper die unit is further arranged above the lower die unit, the rough spinning wheel and one of the shaping spinning wheels are mounted on the spinning wheel mounting unit on one side, the fine spinning wheel and the other of the shaping spinning wheels are mounted on the spinning wheel mounting unit on the other side, the rough spinning wheel and the fine spinning wheel correspond to each other in position, and the shaping spinning wheels on the two sides correspond to each other in position.

6. The method for coreless spinning of a large-ratio multi-variable-diameter hollow shaft according to claim 5, wherein the upper die unit comprises an upper die switch-over base and an upper die core, the bottom of the upper die core is provided with an upper die cavity, the upper die core is embedded in the upper die switch-over base, and the upper die core is in running fit and connection with the upper die switch-over base through a bearing.

7. The method for coreless spinning of a large-ratio multi-variable-diameter hollow shaft according to claim 6, wherein the upper die unit further comprises a cover plate arranged below the upper die switch-over base, the cover plate is connected to the upper die switch-over base through a positioning bolt is circumferentially arranged around an outer side of the upper die core, an extended segment is arranged around a bottom inner side of the cover plate, and the protruding segment matches and is in lap joint with the extended segment.

8. The method for coreless spinning of a large-ratio multi-variable-diameter hollow shaft according to claim 6, wherein the upper die core is in running fit with the upper die switch-over base through a radial bearing and a plane bearing.

* * * * *